US008070285B2

(12) United States Patent
Sawada

(10) Patent No.: US 8,070,285 B2
(45) Date of Patent: Dec. 6, 2011

(54) RECORDING DEVICE

(75) Inventor: Keishi Sawada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 315 days.

(21) Appl. No.: 12/407,060

(22) Filed: Mar. 19, 2009

(65) Prior Publication Data

US 2009/0244242 A1 Oct. 1, 2009

(30) Foreign Application Priority Data

Mar. 27, 2008 (JP) ..... 2008-082862

(51) Int. Cl.
*B41J 2/01* (2006.01)

(52) U.S. Cl. ..... 347/104; 347/101

(58) Field of Classification Search ..... 347/101, 347/104

See application file for complete search history.

(56) References Cited

U.S. PATENT DOCUMENTS

| | | | | |
|---|---|---|---|---|
| 6,270,074 | B1 * | 8/2001 | Rasmussen et al. | 271/276 |
| 6,406,017 | B1 * | 6/2002 | Yaneda | 271/276 |
| 6,964,468 | B2 * | 11/2005 | Kitahara et al. | 347/42 |
| 6,981,766 | B2 * | 1/2006 | Tsuji | 347/104 |
| 7,093,933 | B2 * | 8/2006 | Tsuji et al. | 347/104 |
| 7,354,147 | B2 * | 4/2008 | Beehler | 347/104 |
| 2007/0126832 | A1 * | 6/2007 | Kito | 347/101 |

FOREIGN PATENT DOCUMENTS

| | | |
|---|---|---|
| JP | 04-085234 | 3/1992 |
| JP | 10-315551 | 12/1998 |
| JP | 2003-159841 | 6/2003 |
| JP | 2004-018151 | 1/2004 |

OTHER PUBLICATIONS

U.S. Appl. No. 12/410,197, Mail Date May 26, 2011, Office Action.

* cited by examiner

*Primary Examiner* — Ryan Lepisto
(74) *Attorney, Agent, or Firm* — Workman Nydegger

(57) ABSTRACT

A recording device includes: a recording head which performs a recording operation on a recording medium; a transport member which has a plurality of through holes arranged therein and transports the recording medium; and a suction unit which has a suction force generating section for generating a suction force for sucking air and a plurality of communication channels for communicating the suction force generating section with the respective through holes and generates a suction force in the through holes to suck the recording medium onto the transport member. On the upstream side of the recording area in a transport direction, a suction force at the center in a direction perpendicular to the transport direction of the recording medium is larger than a suction force at the opposite ends.

6 Claims, 12 Drawing Sheets

RECORDING DEVICE

BACKGROUND

1. Technical Field

The present invention relates to a recording device, and more particularly, to a recording device which has a transport member for applying suction to and transporting a recording medium.

2. Related Art

There are recording devices which have a mechanism for transporting a recording medium. In Japanese Patent No. 3707640, a recording device is described, which has a belt as a transport member having a suction face including holes for applying suction to a recording medium. The suction face including holes communicates with a negative-pressure source and applies suction to a recording medium. In this manner, the recording medium is securely held and accuracy of hitting positions of ink droplets is improved.

Since a recording medium has a thin sheet shape, it may be warped when being transported to the recording device. In addition, in the case of double face printing, when printing is performed on one side and then performed on the other side, a recording medium may be strongly warped by ink adhered to the recording medium.

When a recording medium floats up from a transport member because of its warp and an area including the floating area is firstly sucked onto the transport member, it becomes difficult to apply suction to the recording medium while overcoming rigidity of the transport member. Accordingly, the entire face of the recording medium may not be brought into close contact with the transport member. In this case, a constant interval between a recording head and the recording medium cannot be maintained and thus recording quality is deteriorated. In some cases, a paper jam occurs.

SUMMARY

According to an aspect of the invention, a recording device includes: a recording head which performs a recording operation on a recording medium; a transport member which has a plurality of through holes arranged therein and transports the recording medium; and a suction unit which has a suction force generating section for generating a suction force for sucking air and a plurality of communication channels for communicating the suction force generating section with the respective through holes and generates a suction force in the through holes to suck the recording medium onto the transport member, and on the upstream side of the recording area in a transport direction, a suction force at the center in a direction perpendicular to the transport direction of the recording medium is larger than a suction force at the opposite ends. Accordingly, the recording medium is strongly sucked at a center section in the width direction perpendicular to the transport direction. Therefore, even when the recording medium has a warp in which the center section in the width direction is swollen, the recording medium can be brought into close contact with the transport member over the entire width thereof.

In the recording device, the suction force at the opposite ends may gradually increase from the upstream side in the transport direction to the recording area in the suction unit. Accordingly, in the course in which the recording medium reaches the recording area, the recording medium is sequentially sucked from the center side and then sucked onto the transport member over the entire width thereof when being transported to the recording area.

In the recording device, on the upstream side in the transport direction, the number of the communication channels at the center in the direction perpendicular to the transport direction of the recording medium may be larger than the number of the communication channels at the opposite ends. Accordingly, the above functions can be formed with a simple structure.

In the recording device, the suction unit may include flow rate adjusting sections arranged to correspond to the through holes and provided to decrease a channel cross-sectional area of the communication channels corresponding to the through holes which are opened, as compared to a channel cross-sectional area of the communication channels corresponding to the through holes which are blocked by the recording medium. Accordingly, a flow rate of sucked air is decreased in an area in the transport member on which the recording medium is not mounted, and thus an energy efficiency of the entire recording device is improved. In addition, strong suction occurs in an area in the transport member on which the recording medium is mounted, and thus the recording medium can be securely and accurately transported.

In the recording device, the suction unit may have the through holes and the flow rate adjusting sections corresponding to the through holes in the range from the center to the opposite ends in the direction perpendicular to the transport direction of the recording medium on the upstream side in the transport direction, and on the upstream side in the transport direction, an air flow rate adjusted by the flow rate adjusting sections for the through holes which are opened at the center in the direction perpendicular to the transport direction of the recording medium may be larger than an air flow rate adjusted by the flow rate adjusting sections for the through holes which are opened at the opposite ends. Accordingly, using the flow rate adjusting sections, the suction force at the center can be made stronger than the suction force at the opposite ends.

In the recording device, on the upstream side in the transport direction, the number of the flow rate adjusting sections arranged to correspond to the plurality of communication channels at the center in the direction perpendicular to the transport direction of the recording medium may be smaller than the number of the flow rate adjusting sections arranged to correspond to the plurality of communication channels at the opposite ends. Accordingly, a state in which the suction force at the center is larger than the suction force at the opposite ends can be regularly formed.

In the recording device, the communication channel may have a hole-side channel section which is closer to the through holes than the flow rate adjusting section and a suction-side channel section which is closer to the suction force generating section than the flow rate adjusting section, and the flow rate adjusting section may have a diaphragm which is arranged between the hole-side channel section and the suction-side channel section and is displaced toward the hole-side channel section or the suction-side channel section by a differential pressure between the hole-side channel section and the suction-side channel section, an open-close communication hole which is formed in the diaphragm, is opened and closed by the displacement of the diaphragm and communicates the hole-side communication section with the suction-side communication section in an opened state, and an open communication hole which is formed in the diaphragm, is opened regardless of the position of the diaphragm and communicates the hole-side communication section with the suction-side communication section. Accordingly, the flow rate adjusting section can be formed with a simple structure.

According to another aspect of the invention, a recording device includes: a first suction unit which sucks and supports a recording medium; a recording head which performs a recording operation on the recording medium supported by the first suction unit; and a second suction unit which sucks and transports the recording medium to supply the recording medium to the first suction unit, the second suction unit has a first area in which a first suction force is generated and a second area in which a second suction force smaller than the first suction force is generated or no suction force is generated, the first area is disposed closer to the center than the second area in a direction perpendicular to a transport direction and gradually increases along the transport direction, and the second area is disposed closer to the opposite ends than the first area in the direction perpendicular to the transport direction and gradually decreases in size along the transport direction. Accordingly, the recording medium is strongly sucked at the center in the width direction perpendicular to the transport direction. Therefore, even when the recording medium has a warp in which a center section in the width direction is swollen, the recording medium can be brought into close contact with the transport member over the entire width thereof. Moreover, in the course in which the recording medium is supplied to the first area, the recording medium is sequentially sucked from the center side, and then sucked onto the wide first area when being transported to the first area.

The above description of the invention does not include all the features of the invention and subcombinations of the features can construct the invention.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described and the following embodiments do not limit the invention, which is defined in the claims. In addition, all the combinations of features described in the embodiments are not essential to the invention.

Figure 1:
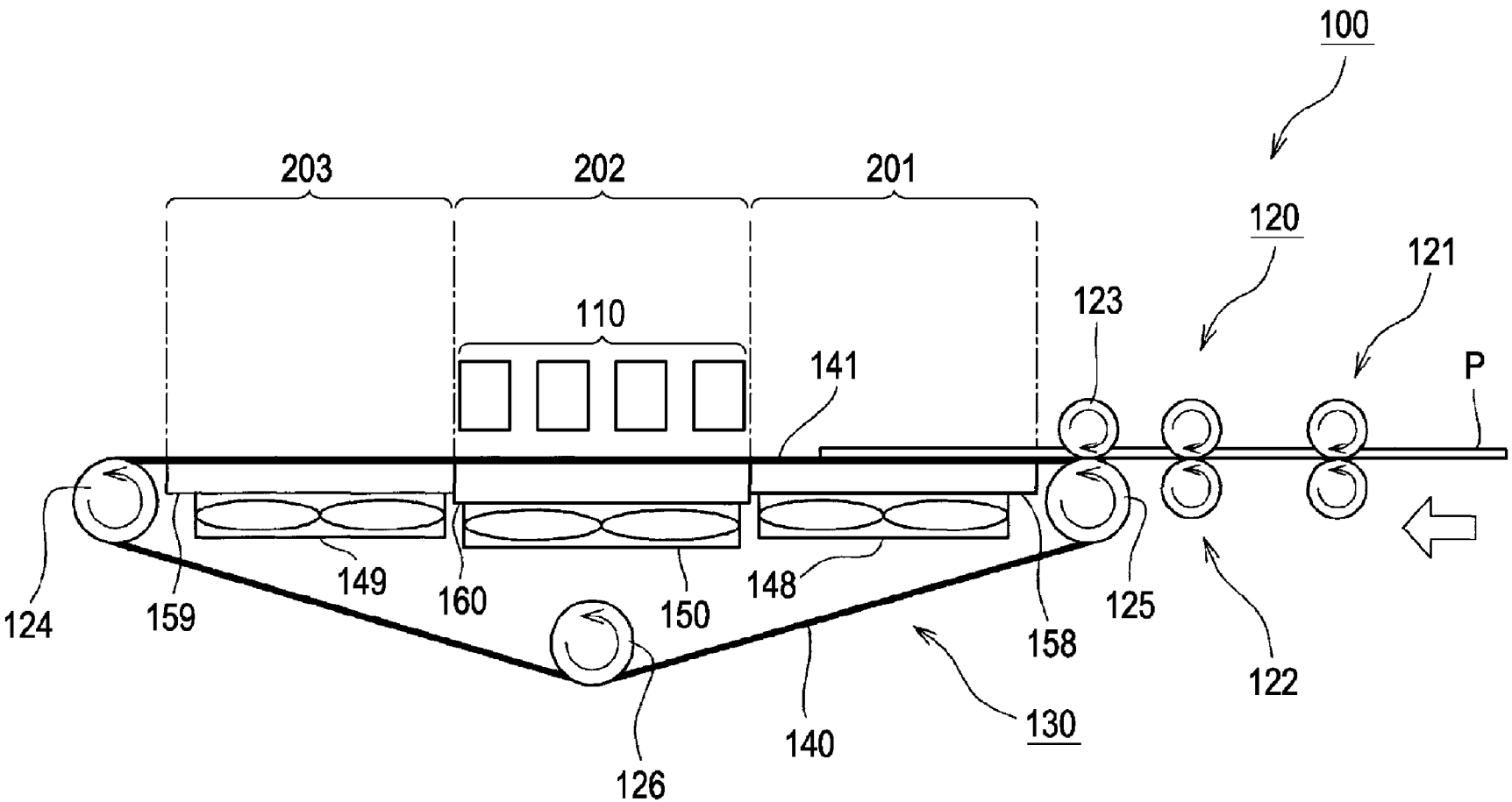
FIG. 1 is a side view illustrating the schematic structure of a recording device.

FIG. 1 is a side view illustrating the schematic structure of an ink jet recording device 100 according to this embodiment. As illustrated in the drawing, the recording device 100 has a transport unit 120 which transports a sheet P as a recording medium and plural recording heads 110 which eject ink onto the sheet P to perform a recording operation.

The transport unit 120 has a drive roller 124, driven rollers 125 and 126 and an endless transport belt 140 as a transport member extended over the rollers. The drive roller 124 and the driven roller 125 are substantially horizontally arranged and the driven roller 126 is arranged below a middle position in-between the drive roller 124 and the driven roller 125. That is, the transport belt 140 is made to extend in a substantially triangular shape by the drive roller 124 and the driven rollers 125 and 126 and a part of the transport belt 140 (hereinafter, referred to as "upper face 141") is made to substantially horizontally extend by the drive roller 124 and the driven roller 125. A transport drum can be also applied as the transport member.

The recording heads 110 are arranged to be opposed to the upper face 141 of the transport belt 140. On the upstream side of the transport unit 120 in a transport direction, a feed roller 121, a gate roller 122 and a sheet pressing roller 123 are sequentially arranged from the upstream side in the transport direction and the sheet P is transported to the transport unit 120 by the rollers.

In addition, the transport unit 120 has a sheet sucking device 130 as a suction unit. The sheet sucking device 130 has fans 148, 150 and 149 as a suction force generating section, an upstream chamber 158, a recording area chamber 160 and a downstream chamber 159. The fans 148, 150 and 149 are sequentially arranged in the transport direction on an inner circumferential side of the transport belt 140. The upstream chamber 158 is arranged between the upper face 141 and the fan 148, the recording area chamber 160 is arranged between the upper face 141 and the fan 150, and the downstream chamber 159 is arranged between the upper face 141 and the fan 149.

The upstream chamber 158 and the fan 148 are arranged in an upstream area 201 on the upstream side of a recording area 202 of the recording heads 110 and the recording area chamber 160 and the fan 150 are arranged to be opposed to the recording area 202 of the recording heads 110. The downstream chamber 159 and the fan 149 are arranged in a downstream area 203 on the downstream side of the recording area 202 of the recording heads 110.

Figure 2:
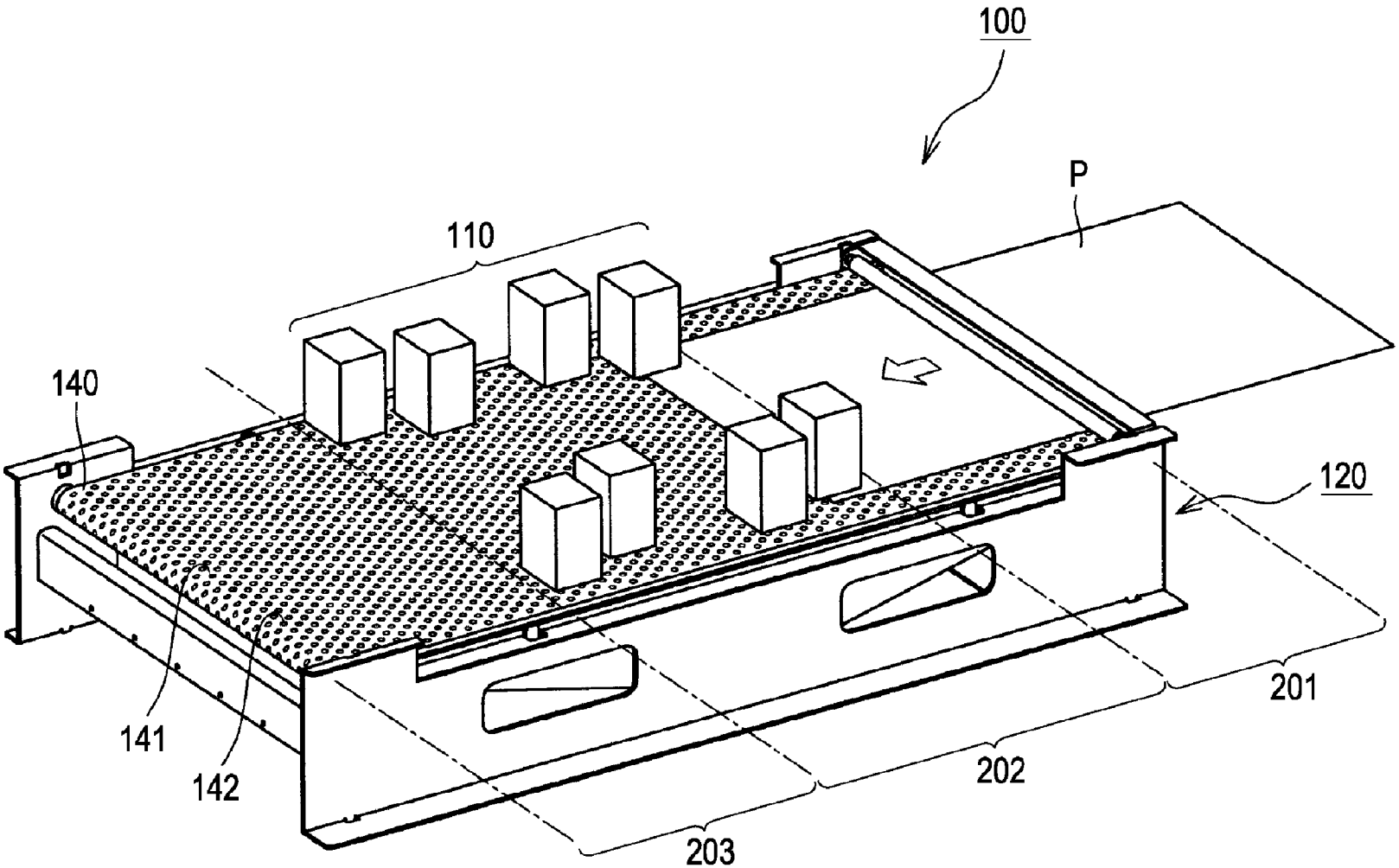
FIG. 2 is a perspective view illustrating the inner structure of the recording device.

FIG. 2 is a perspective view illustrating the inner structure of the recording device 100. As illustrated in the drawing, each of the recording heads 110 is shorter than a width of the sheet P and they are vertically and horizontally arranged in a direction perpendicular to the transport direction (hereinafter, referred to as "sheet width direction") and the transport direction. The recording heads 110 are arranged in a zigzag manner in the transport direction.

Plural through holes 142 are vertically and horizontally arranged along the sheet width direction and the transport direction over the entire area of the transport belt 140. The through holes 142 are arranged in a zigzag manner in the transport direction.

Figure 3:
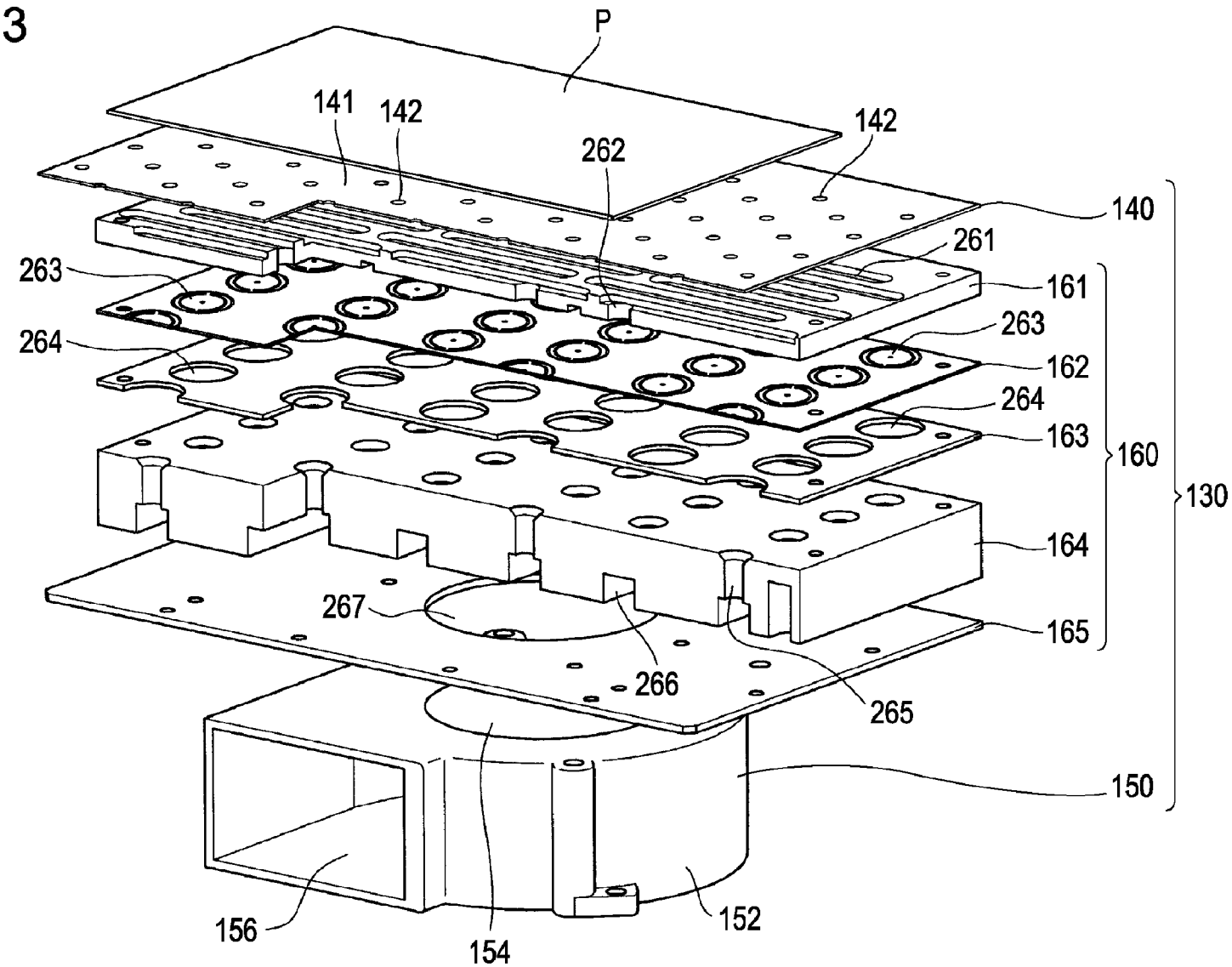
FIG. 3 is an exploded perspective view illustrating a fan and a recording area chamber in a sheet sucking device.

FIG. 3 is an exploded perspective view illustrating the fan 150 and the recording area chamber 160 in the sheet sucking device 130. Since the fans 148 and 149 and the upstream and downstream chambers 158 and 159 have the same structure as the fan 150 and the recording area chamber 160, respectively, a description thereof will be omitted.

As illustrated in the drawing, the fan 150 has a housing 152 and a blade (not shown) arranged in the housing 152. A circular intake port 154 is formed in a face of the housing 152 on the side of the recording area chamber 160 and an exhaust port 156 is formed in a side face of the housing 152. Other than the fan 150, a blower, a pump or the like can be applied as the suction force generating section.

The recording area chamber 160 has a belt receiving plate 161, a valve plate 162, a spacer plate 163, a body 164 and a sealing plate 165. The belt receiving plate 161, the valve plate 162, the spacer plate 163, the body 164 and the sealing plate 165 are sequentially laminated in a direction from the upper face 141 toward the fan 150.

In the belt receiving plate 161, plural elliptical grooves 261, the longitudinal direction of which is the transport direction, are vertically and horizontally arranged along the transport direction and the sheet width direction. The grooves 261 are arranged in a zigzag manner in the sheet width direction.

A hole-side channel section 262 is formed at the bottom of the groove 261. The hole-side channel section 262 is formed of a circular through hole. In this embodiment, each groove 261 is provided with one hole-side channel section 262. However, each groove 261 may be provided with plural hole-side channel sections 262.

In the valve plate 162, plural circular valves 263 are formed. The valves 263 are arranged so as to overlap the hole-side channel sections 262. In the spacer plate 163, plural valve chambers 264 are formed. The valve chambers 264 are formed of circular through holes. The hole-side channel sections 262 and the valves 263 are arranged so as to overlap each other and a diameter of the hole-side channel section 262 is equal to a diameter of the valve 263.

The body 164 is provided with plural suction-side channel sections 265. The suction-side channel sections 265 are formed of circular through holes. The suction-side channel sections 265 and the valves 263 are arranged so as to overlap each other. In addition, a diameter of the suction-side channel section 265 is smaller than a diameter of the valve 263. A lower portion of the body 164 is provided with a channel 266 which communicates the suction-side channel sections 265 with each other.

In the sealing plate 165, a circular through hole 267 is formed so as to overlap the intake port 154 of the fan 150. A diameter of the through hole 267 is equal to a diameter of the intake port 154 and the intake port 154 and the channel 266 communicate with each other via the through hole 267.

Figure 4:
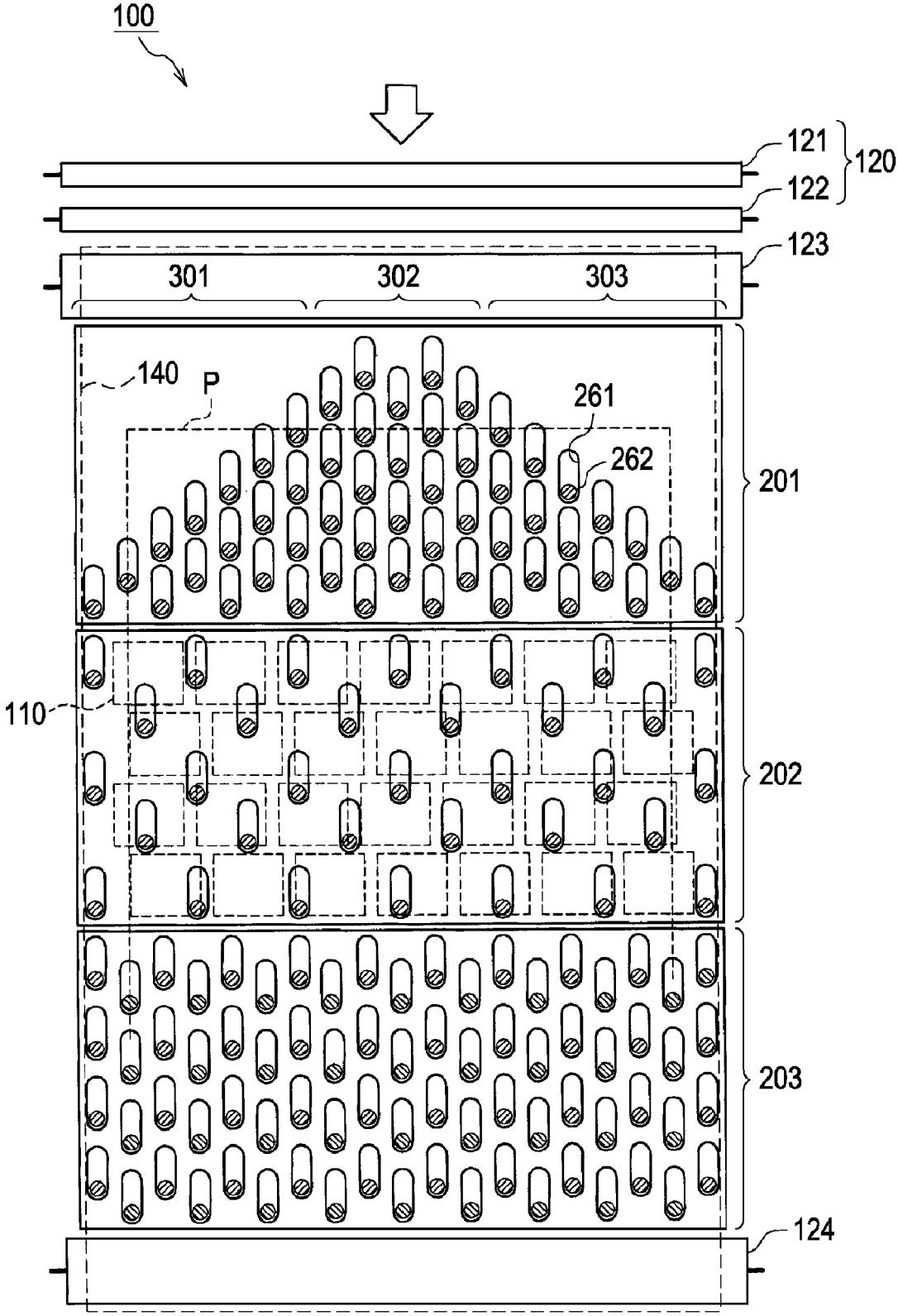
FIG. 4 is a plan view illustrating the layout of hole-side channel sections of a belt receiving plate.

FIG. 4 is a plan view illustrating the layout of the hole-side channel sections 262 of the belt receiving plate 161. As illustrated in the drawing, the belt receiving plate 161 is divided into the upstream area 201, the recording area 202 and the downstream area 203 along the transport direction of the sheet P indicated by the outline arrow in the drawing.

In the upstream area 201, the sheet P transported by the transport unit 120 is subjected to suction via the transport belt 140. In the recording area 202, the sheet P subjected to suction and advancing with the transport belt 140 passes under the recording heads 110 and ink is ejected thereonto. In the downstream area 203, the sheet P on which the recording operation has been performed is strongly sucked onto the transport belt 140 to be discharged to the outside of the recording device 100.

In the belt receiving plate 161, the hole-side channel sections 262 which communicate with the fan 148 to generate a suction force are arranged in the upstream area 201, the recording area 202 and the downstream area 203. Herein, the hole-side channel sections 262 are substantially uniformly arranged in the recording area 202 and the downstream area 203, although the areas 202 and 203 have different arrangement densities. On the other hand, in the upstream area 201, the hole-side channel sections 262 are arranged in a certain distribution.

That is, the upstream area 201 has a pair of end sections 301 and 303 and a center section 302 arranged in the direction perpendicular to the transport direction. In the center section 302, the hole-side channel sections 262 are arranged along the entire length of the upstream area 201 with respect to a hole transport direction. On the other hand, in the pair of end sections 301 and 303, the hole-side channel sections 262 are arranged so that the number of the hole-side channel sections 262 gradually increases in the transport direction.

In this manner, the area in which the hole-side channel sections 262 are arranged exhibits a suction force and forms a first area which gradually becomes large in the transport direction. The area in which no hole-side channel sections 262 are arranged does not exhibit a suction force and gradually becomes small in the transport direction to form a second area.

In the upstream side area 201 in the transport direction, the number of the hole-side channel sections 262 in the center section 302 in the direction perpendicular to the transport direction of the sheet P may be larger than the number of the hole-side channel sections 262 of the end sections 301 and 303. Therefore, the following functions can be formed with a simple structure.

The suction forces generated by the respective hole-side channel sections 262 are the same. Accordingly, in the upstream area 201, the suction force changes along the transport direction due to the above-described arrangement. That is, when the sheet P transported by the transport belt 140 initially enters the upstream area 201, the hole-side channel sections 262 in the center section 302 of the belt receiving plate 161 are opened and none of the hole-side channel sections 262 are present in the end sections 301 and 303. Therefore, the suction force is generated only in an upper portion of the center section 302 on the surface of the transport belt 140.

When the sheet P further advances with the advance of the transport belt 140, the hole-side channel sections 262 in the end sections 301 and 303 are opened. Accordingly, the sheet P is also sucked onto the side sections of the transport belt 140. As described above, first, the sheet P is subjected to suction at the center in the upstream area 201, and then sequentially sucked toward the side end sections as being transported.

In this manner, on the surface of the transport belt 140, the suction force in the opposite end sections 301 and 303 may gradually increase from the upstream area 201 to the recording area 202 in the transport direction. Accordingly, in the process in which the sheet P reaches the recording area 202, the sheet P is gradually subjected to suction from the center section 302 to the end sections 301 and 303, and thus sucked onto the transport belt 140 over the entire width thereof when being transported to the recording area 202.

Accordingly, even when a minus curl in which the center floats up is caused in the sheet P, the sheet P is brought into close contact with the transport belt 140 over the entire width thereof since the center section is subjected to suction and then the side end sections are sequentially subjected to suction.

As described above, the recording device 100 is formed, which has the recording heads 110 performing a recording operation by ejecting ink onto the sheet P, the transport belt 140 provided with the through holes 142 and transporting the sheet P to the recording area 202 of the recording heads 110, the fan 149 generating a suction force for sucking air and the suction unit having plural communication channels for communicating the fan 149 with the respective through holes 142 and generating a suction force in the through holes 142 to suck the sheet P onto the transport belt 140 and in which in the upstream area 201 on the upstream side of the recording area 202 in the transport direction, a suction force of the center section 302 is larger than a suction force of the opposite end sections 301 and 303 in the direction perpendicular to the transport direction of the sheet P. Accordingly, a recording medium is more strongly subjected to suction at the center section in the width direction perpendicular to the transport direction. Thus, even when the recording medium has a warp in which the center section in the width direction is swollen, the recording medium can be brought into close contact with the transport member over the entire width thereof.

Figure 5:
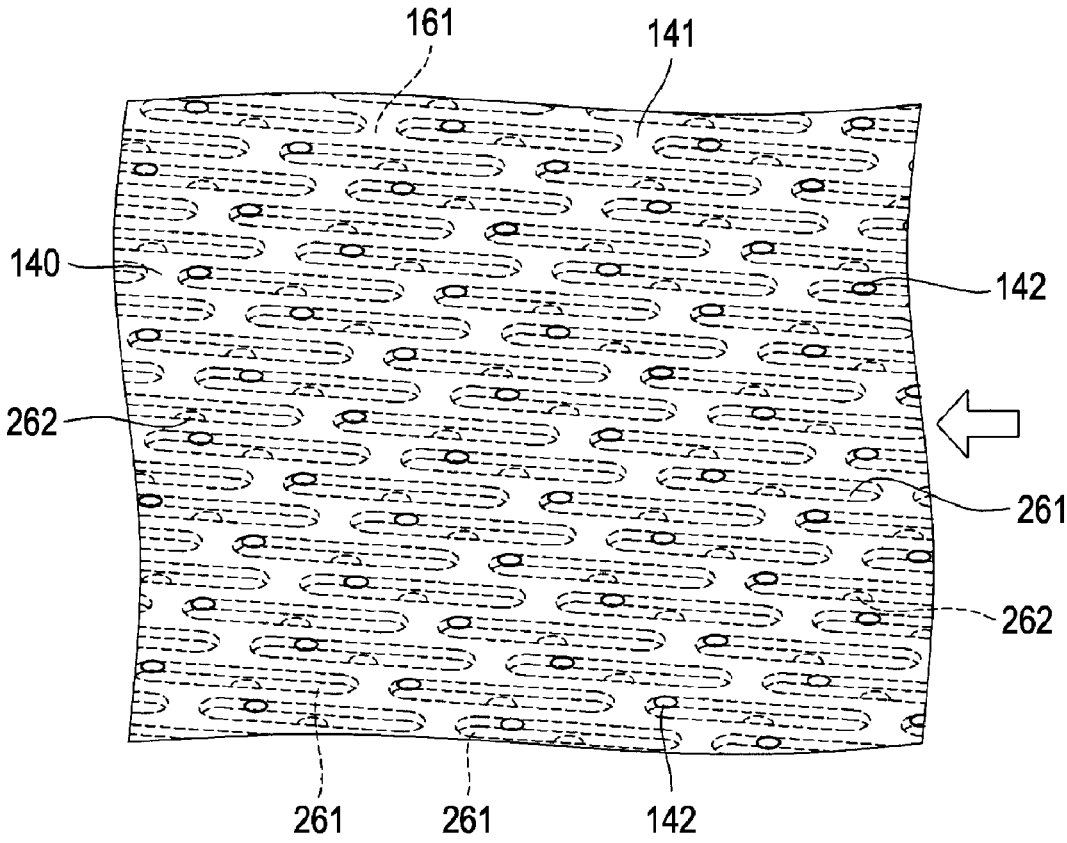
FIG. 5 is an enlarged perspective view illustrating a transport belt and the belt receiving plate.

FIG. 5 is an enlarged perspective view illustrating the transport belt 140 and the belt receiving plate 161. As illustrated in the drawing, the grooves 261 are arranged so as to overlap the arrays of the through holes 142 arranged in the transport direction. A length of the groove 261 in the transport direction is equal to an interval between the through holes 142 aligned in the transport direction, and the groove 261 is provided so as to overlap any through hole 142 when the transport belt 140 moves.

Figure 6:
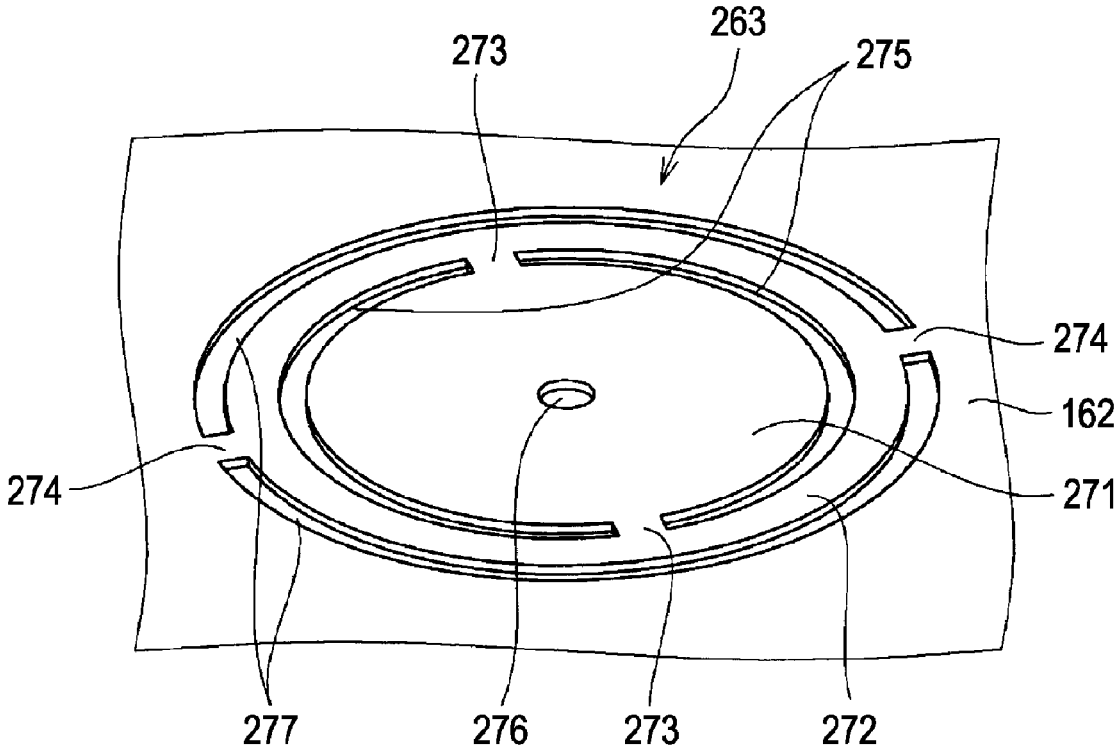
FIG. 6 is a perspective view illustrating a valve.

FIG. 6 is a perspective view illustrating the valve 263. As illustrated in the drawing, the valve 263 has a diaphragm 271, a support section 272, a pair of arms 273, a pair of arms 274, a pair of slits 275 as an open-close communication hole and an open communication hole 276. The diaphragm 271 is formed in a circular shape and the pair of slits 275 having a semicircular shape is formed around the diaphragm 271 to be symmetrical to each other with respect to the center of the diaphragm 271. The open communication hole 276 is formed at the center of the diaphragm 271.

In addition, the support section 272 having a circular shape is arranged around the pair of slits 275. The diaphragm 271 is supported at both sides by the pair of arms 273 provided between the opposite ends of the pair of slits 275. A pair of semicircular slits 277 is formed around the support section 272 to be symmetrical to each other with respect to the open communication hole 276. The support section 272 is supported at the valve plate 162 at both sides by the pair of arms 274 provided between the opposite ends of the pair of slits 277.

Herein, the opposite ends of the slit 275 and the opposite ends of the slit 277 are arranged around the open communication hole 276 with their phases shifted by 90°. The arms 273 and 274 are arranged around the open communication hole 276 with their phases shifted by 90°. That is, the valve 263 has a so-called gimbal structure. The valve plate 162 is made of an elastically deformable metal material or a resin material and the valve 263 is formed by etching or punching of metal or molding or punching of resin.

Figure 7:
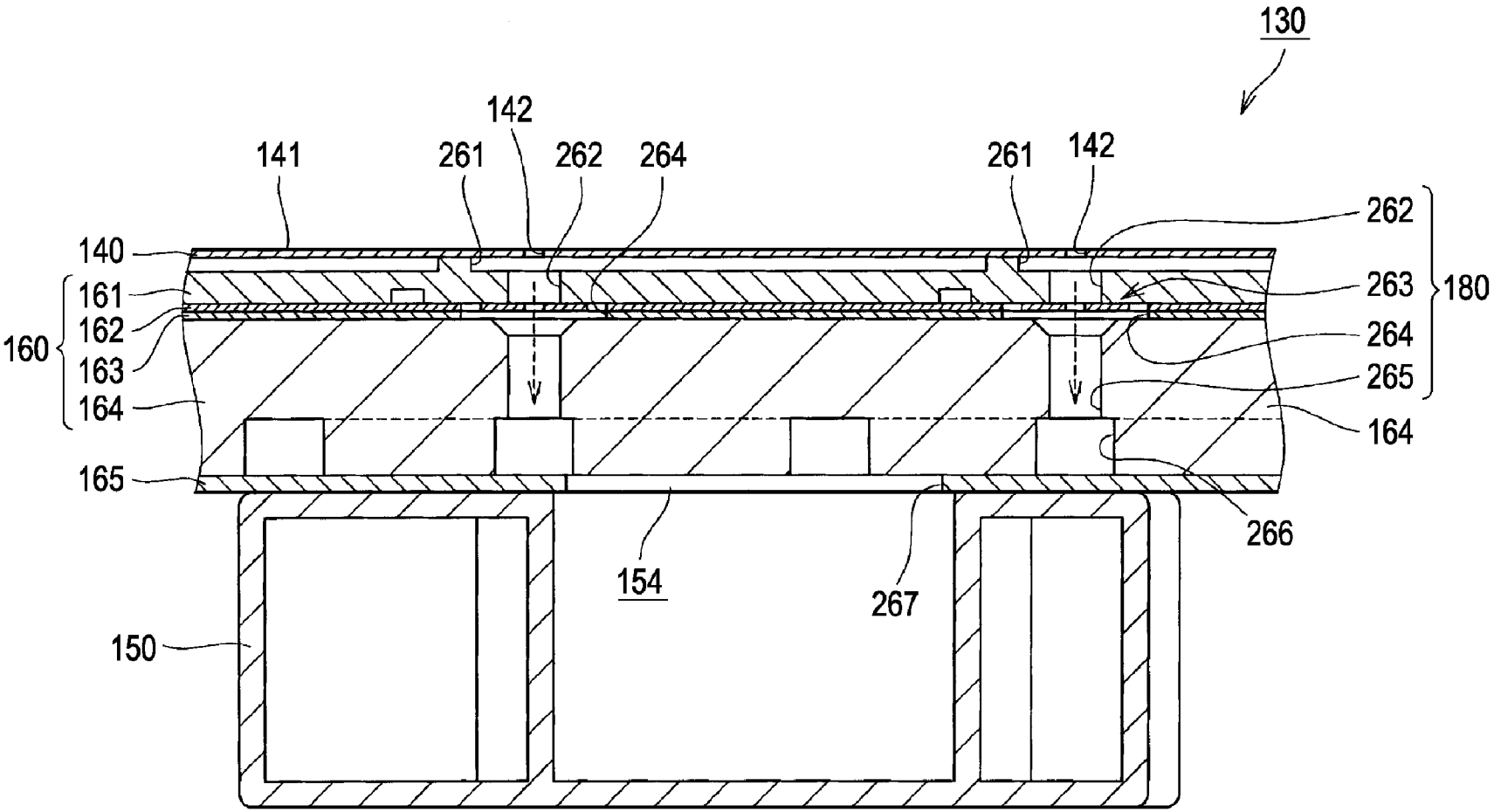
FIG. 7 is a partial sectional view illustrating the sheet sucking device.

FIG. 7 is a partial sectional view illustrating the sheet sucking device 130. As illustrated in the drawing, the hole-side channel section 262, the open communication hole 276, the valve chamber 264 and the suction-side channel section 265 are arranged so that axial centers thereof are aligned on the same straight line indicated by the dashed line in the drawing. Accordingly, a communication channel 180 communicating the through hole 142 with the fan 150 is formed.

A diameter of the diaphragm 271 is larger than a diameter of the hole-side channel section 262 and a diameter of the suction-side channel section 265 and thus the slit 275 is positioned closer to the outer diameter side than the hole-side channel section 262 and the suction-side channel section 265. Accordingly, as illustrated in the drawing, when the diaphragm 271 is flush with the valve plate 162, the slit 275 is blocked by the belt receiving plate 161.

Figure 8:
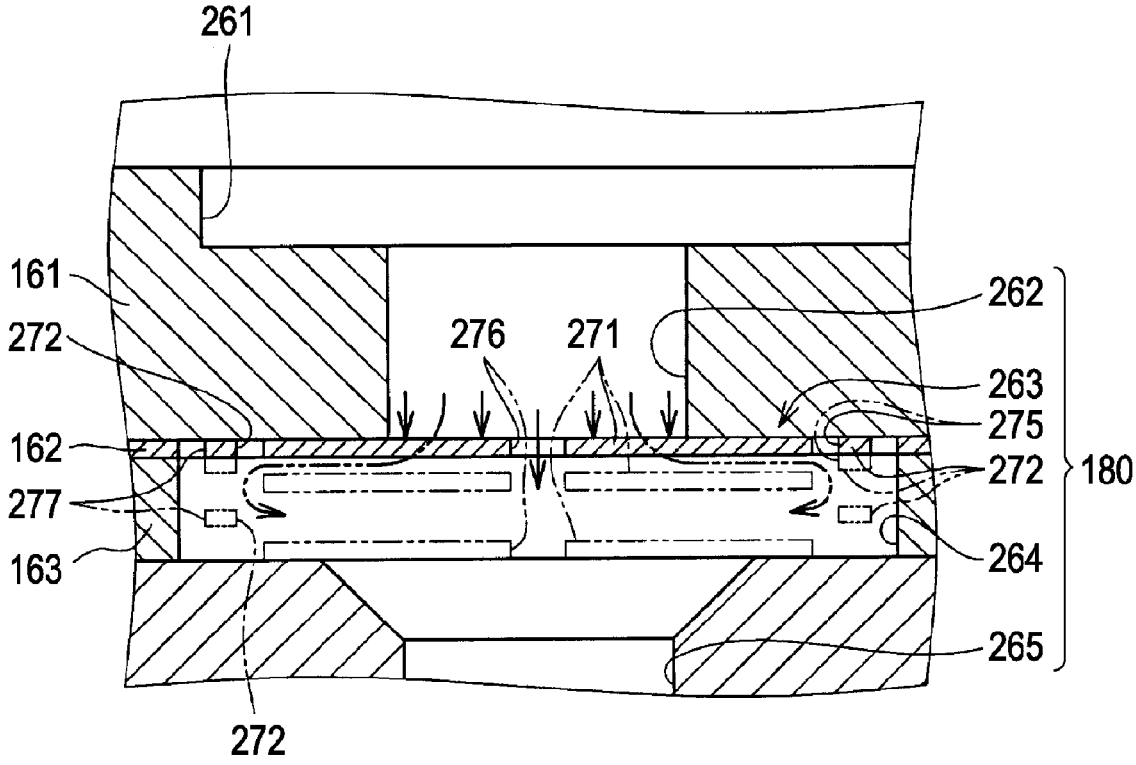
FIG. 8 is a schematic sectional side view illustrating the operation of the valve and air flows in a communication channel.

FIG. 8 is a schematic sectional side view illustrating the operation of the valve 263 and air flows in the communication channel 180. As indicated by the chain double-dashed lines in the drawing, when the suction-side channel section 265 has a negative pressure lower than that of the hole-side channel section 262 due to driving of the fan 150, the diaphragm 271 elastically deforms the arm 273 toward the suction side to displace the arm 273 toward the suction side.

When the through hole 142 is not blocked by the sheet P, the pressure in the hole-side channel section 262 is approximately atmosphere pressure and the suction-side channel section 265 has a negative pressure. Therefore, a differential pressure between the sections increases. In this pressure state, the diaphragm 271 moves downward up to the lowest position of the valve chamber 264 to be brought into contact with an upper face of the body 164. Accordingly, since the slit 275 is blocked by the upper face of the body 164, all of the air flows in the communication channel 180 pass through the open communication hole 276.

On the other hand, when the through hole 142 is blocked by the sheet P, the pressure in the hole-side channel section 262 becomes a negative pressure and a differential pressure between the hole-side channel section 262 and the suction-side channel section 265 decreases. In this pressure state, the diaphragm 271 is stopped at a position in which a restoring force caused by the elasticity of the arms 273 and 274 is balanced with a force of the air flows in the communication channel 180 pressing the diaphragm 271.

Herein, the position at which the diaphragm 271 is stopped is an intermediate position between the highest position and the lowest position of the valve chamber 264 and the slit 275 is opened. Accordingly, the air flows in the communication channel 180 pass through the open communication hole 276 and the slit 275.

That is, when the through hole 142 is opened, a channel cross-sectional area of the valve chamber 264 decreases, and when the through hole 142 is blocked, the channel cross-sectional area of the valve chamber 264 increases. Accordingly, when the through hole 142 is opened, a suction force generated in the through hole 142 decreases. However, when the through hole 142 is blocked, a suction force generated in the through hole 142 increases.

When the open communication hole 276 is not formed in the diaphragm 271, the diaphragm 271 completely blocks the communication channel 180 in a state in which the through hole 142 is not blocked by the sheet P. Accordingly, even when the through hole 142 is subsequently opened, the pressure in the hole-side channel section 262 is not lowered from the atmosphere pressure, and thus the suction from the through hole 142 does not occur and the sheet P is not sucked onto the transport belt 140.

The communication channel 180 may have the hole-side channel section 262 which is closer to the through hole 142 than the valve 263 and the suction-side channel section 265 which is closer to the fan 148 than the flow rate adjusting section, and the valve 263 may have the diaphragm 271 which is arranged between the hole-side channel section 262 and the suction-side channel section 265 and is displaced toward the hole-side channel section 262 or the suction-side channel section 265 by the differential pressure between the hole-side channel section 262 and the suction-side channel section 265, the open-close communication hole which is formed in the diaphragm 271, is opened and closed by the displacement of the diaphragm and communicates the hole-side channel section 262 with the suction-side channel section 265 and the open communication hole 276 which is formed in the diaphragm 271, is opened regardless of the position of the diaphragm 271 and communicates the hole-side channel section 262 with the suction-side channel section 265. Accordingly, the flow rate adjusting section can be formed with a simple structure and the operation thereof can be easily adjusted.

Further, the suction unit may be provided with the plural valves 263 which are at least arranged in the plural communication channels 180 in the recording area to increase a channel cross-sectional area of the hole-side channel sections 262 corresponding to the through holes 142 blocked by the sheet P and decrease a channel cross-sectional area of the communication channels corresponding to the opened through holes. Accordingly, since a flow rate of the air sucked in an area on which the sheet P is not mounted in the transport belt 140 is decreased, an energy efficiency of the entire recording device 100 is improved. Moreover, since strong suction occurs in an area on which the sheet P is mounted in the transport belt 140, the recording sheet P can be securely and accurately transported.

Figure 9:
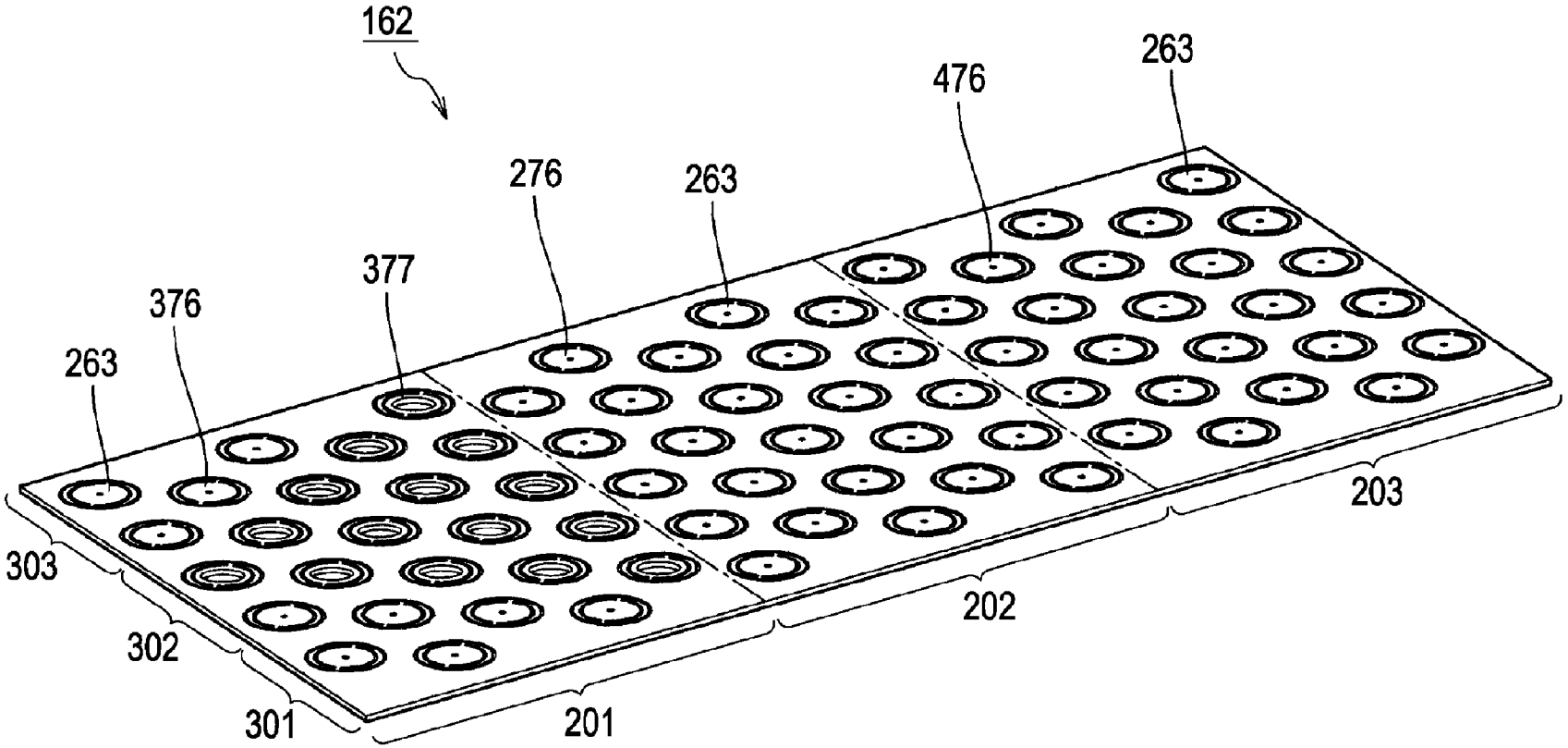
FIG. 9 is a perspective view illustrating a valve plate disposed in an upstream chamber, a recording area chamber and a downstream chamber.

FIG. 9 is a perspective view illustrating the valve plate 162 disposed in the upstream chamber 158, the recording area chamber 160 and the downstream chamber 159. The valve plate 162 disposed in the recording area 202 is provided with the open communication holes 276, the valve plate 162 disposed in the upstream area 201 is provided with open communication holes 376, and the valve plate 162 disposed in the downstream area 203 is provided with open communication holes 476.

In the center section 302 of the upstream area 201, each of the valves 263 has an open communication hole 377 the diameter of which is larger than that of the valve 263. In the end sections 301 and 303 of the upstream area 201, the valves 263 each having the open communication hole 376 the diameter of which is smaller than that of the valve 263 are arranged in the plural communication channels. Accordingly, the number of the valves 263 each having the open communication hole 377 the diameter of which is larger than that of the valve 263 increases in a width direction toward the downstream side in the transport direction.

In the upstream area 201 in the transport direction, an air flow rate adjusted by the opened open communication holes 276 in the center section 302 in the direction perpendicular to the transport direction of the sheet P is larger than an air flow rate adjusted by the valves 263 of the open communication holes 376 in the end sections 301 and 303. Accordingly, by using the valves 263, a suction force in the center section 302 can be made stronger than a suction force in the opposite end sections 301 and 303.

Moreover, since the number of the valves 263 each having the large open communication hole 377 increases along the transport direction, a width of a sucked area in the sheet P is gradually increased from the center to the side ends. The sheet P is sucked onto the transport belt 140 over the entire width thereof when reaching the recording area 202.

Accordingly, the area at the center, in which the valves 263 each having the large open communication hole 377 are arranged, exhibits a larger suction force than that in the opposite ends and forms the first area which gradually becomes large along the transport direction. The area in which the valves 263 each having the small-diameter open communication hole 376 are arranged generates a smaller suction force and gradually becomes small along the transport direction to form the second area.

When the valves 263 which have the open communication holes 276 with the same diameter, respectively, are arranged over the entire upstream area 201, the suction force for a floating area of the sheet P is significantly lower than that for a previously sucked area. Accordingly, when the recording sheet P on the transport belt 140 is warped and a floating area is thus generated, it becomes difficult to apply suction to the area.

Figure 10A:
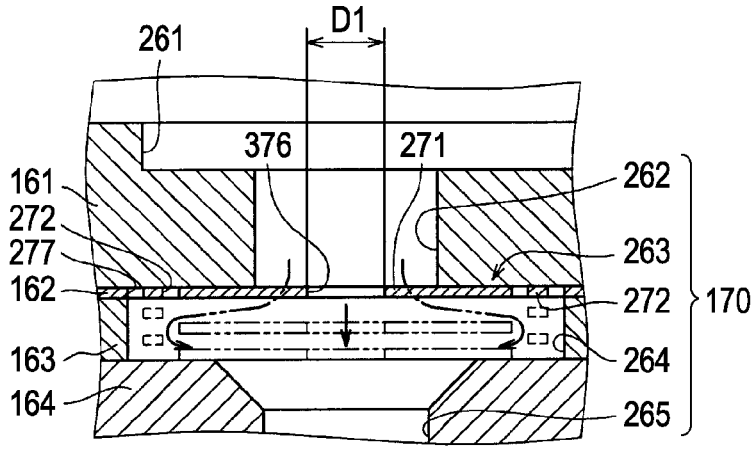
FIGS. 10A to 10C are partial sectional side views illustrating the upstream chamber, the recording area chamber and the downstream chamber.
Figure 10B:
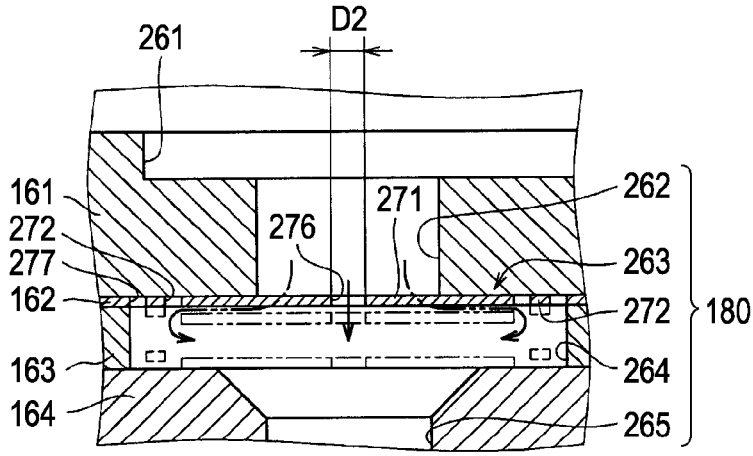
Figure 10C:
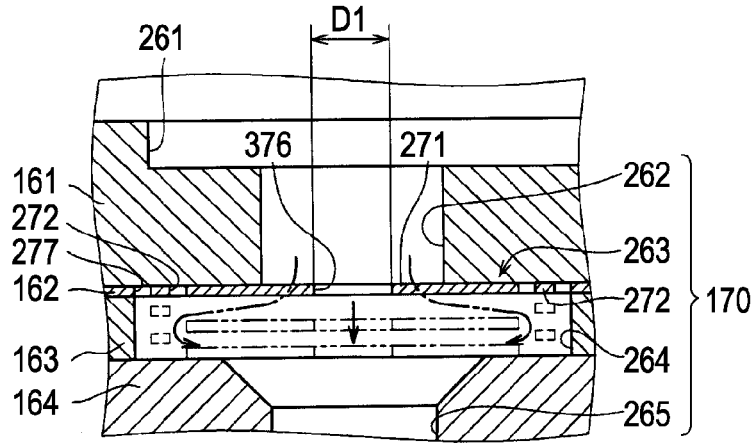

FIGS. 10A to 10C are partial sectional side views illustrating the upstream chamber 158, the recording area chamber 160 and the downstream chamber 159. As illustrated in FIGS. 10A and 10C, hole diameters of the open communication holes 376 and 476 formed in the valve plate 162 disposed in the upstream chamber 158 and the downstream chamber 159 are D1, and a hole diameter of the open communication hole 276 formed in the valve plate 162 disposed in the recording area chamber 160 is D2, which is smaller than D1, as illustrated in FIG. 10B.

Next, actions of the embodiment will be described. In the recording device 100, when a print job is started, the sheet P is transported to a nip section including the driven roller 125 and the sheet pressing roller 123 by the feed roller 121 and the gate roller 122. The sheet P is pressed on the transport belt 140 while passing through the nip section. The number of the sheet pressing rollers 123 may be increased to strongly press and flatten the sheet P.

In the upstream area 201, the sheet P pressed onto the transport belt 140 is sucked onto the upper face 141 of the transport belt 140 by a suction force generated in the through holes 142 by the fan 148, and is transported to the recording area 202 by the rotation of the transport belt 140. In the recording area 202, the sheet P is sucked onto the upper face 141 of the transport belt 140 by a suction force generated in the through holes 142 by the fan 150, and is transported by the transport belt 140. At this time, recording is performed on the sheet P by ejecting ink from the recording heads 110. The sheet P on which the recording operation has been performed is sucked onto the upper face 141 of the transport belt 140 by a suction force generated in the through holes 142 by the fan 149 in the downstream area 203, and is transported to the downstream side of the transport belt 140 to be discharged from the recording device 100.

Herein, while the sheet P is transported to the upstream area 201, the recording area 202 and then the downstream area 203, the through holes 142 of the areas are opened and thus each of the diaphragms 271 blocks the slit 275 at the lowest position of the valve chamber 264. Accordingly, the air channel for the valve chamber 264 becomes a first channel passing through the open communication hole 276 and a channel cross-sectional area of the valve chamber 264 becomes minimum in a changeable range.

When the sheet P is transported to the areas, the through holes 142 positioned outside of the transport areas for the sheet P in the areas are opened, so the channel cross-sectional area of the valve chambers 264 communicating with the through holes 142 does not change. On the other hand, the through holes 142 positioned in the transport areas for the sheet P in the areas are blocked by the sheet P, so inner pressures in the hole-side channel sections 262 communicating with the through holes 142 are lowered and thus a differential pressure between the hole-side channel section 262 and the suction-side channel section 265 decreases. Accordingly, the diaphragm 271 is displaced toward the hole-side channel section 262 and the slit 275 is opened. Thus, the air channel for the valve chamber 264 becomes a second channel passing through the open communication hole 276 and the slit 275 and the channel cross-sectional area of the valve chamber 264 increases.

As hole diameters of the open communication holes 276, 376 and 476 increase, air suction amounts from the open communication holes 276, 376 and 476 when the through holes 142 are blocked by the sheet P and opened increase. Accordingly, promptness of the change in inner pressure of the hole-side channel section 262 increases and thus responsiveness of the diaphragm 271 is improved. In addition, since the air suction amounts from the open communication holes 276, 376 and 476 increase, airflow generated outside the opened open communication holes 276, 376 and 476 becomes strong and thus has an effect on a flight state of the ink.

Herein, the hole diameter of the open communication hole 276 arranged in the recording area 202 is D2 and the hole diameters of the open communication holes 376 and 476 arranged in the upstream area 201 and the downstream area 203 are D1, which is larger than D2. Accordingly, the responsiveness of the diaphragms 271 when the through holes 142 are blocked by the sheet P is more rapid in the recording area 202 than in the upstream area 201 and the downstream area 203. Accordingly, when the sheet P is transported to the vicinity of the through holes 142, the negative pressures of the hole-side channel sections 262 communicating with the through holes 142 are more rapidly generated in the upstream area 201 and the downstream area 203 than in the recording area 202.

Since the channel cross-sectional area of the valve chambers 264 communicating with the opened through holes 142 are narrower in the recording area 202 than in the upstream area 201 and the downstream area 203, the air suction amounts from the opened through holes 142 become smaller in the recording area 202 than in the upstream area 201 and the downstream area 203. Accordingly, airflow generated around the opened through holes 142 in the recording area 202 is weaker than airflow generated around the opened through holes 142 in the upstream area 201 and the downstream area 203.

As described above, the air suction amounts from the through holes 142 which are opened in the recording area 202 can be decreased without decreasing the suction force of the through holes 142 which are blocked by the sheet P in the upstream area 201 and the downstream area 203. Accordingly, the suction force between the transport belt 140 and the sheet P in the upstream area 201 and the downstream area 203 can be sufficiently ensured to sufficiently suppress the floating of the sheet P from the transport belt 140 and weaken airflow generated in the recording area 202, and thus an effect of the airflow on a flight state of ink droplets can be suppressed. This is particularly effective when borderless printing is performed for the front end or back end of the sheet P. Moreover, in the upstream area 201, this is effective from the viewpoint that the sheet P at the stage where the suction onto the transport belt 140 is started can be sucked onto the transport belt 140 in a short time.

In addition, in this embodiment, a channel cross-sectional area of a part of the communication channels 180 is increased or decreased by the displacement of the diaphragms 271 by the differential pressure between the hole-side channel sections 262 and the suction-side channel sections 265. Accordingly, without the change in drive forces for the fans 148, 149 and 150, the suction force of the through holes 142 can be increased when the through holes 142 are blocked by the sheet P, and the suction force of the through holes 142 can be decreased when the through holes 142 are opened.

In this embodiment, a channel cross-sectional area of a part of the communication channels 180 communicating with the opened through holes 142 is narrower in the recording area 202 than in the upstream area 201. Accordingly, the suction force generated in the opened through holes 142 in the recording area 202 can be made weaker than that in the upstream area 201.

Further, in this embodiment, the hole diameters of the open communication holes 276 and 376 formed in the diaphragms 271 are smaller in the recording area 202 than in the upstream area 201. Accordingly, a channel cross-sectional area of a part of the communication channels 180 communicating with the opened through holes 142 in the recording area 202 can be made narrower than those in the upstream area 201.

In this embodiment, some of the valves 263 are arranged in the upstream area 201. Accordingly, in the upstream area 201, the suction force from the opened through holes 142 can be decreased without decreasing the suction force of the through holes 142 blocked by the sheet P. Accordingly, in the upstream area 201, the floating of the sheet P from the transport belt 140 can be sufficiently suppressed and airflow generated in the opened through holes 142 can be weakened to suppress an effect of the airflow on a flight state of ink droplets.

In this embodiment, the upstream chamber 158 and the recording area chamber 160 are arranged in the upstream area 201 and the recording area 202, respectively, and the fans 148 and 150 are provided to correspond to the chambers, respectively. Accordingly, a suction force generated in the through holes 142 blocked by the sheet P can be made stronger than in the case where a suction force is generated in the recording area chamber 160 and the upstream chamber 158 by using one fan and thus the sheet P can be stably sucked onto the transport belt 140.

Figure 11:
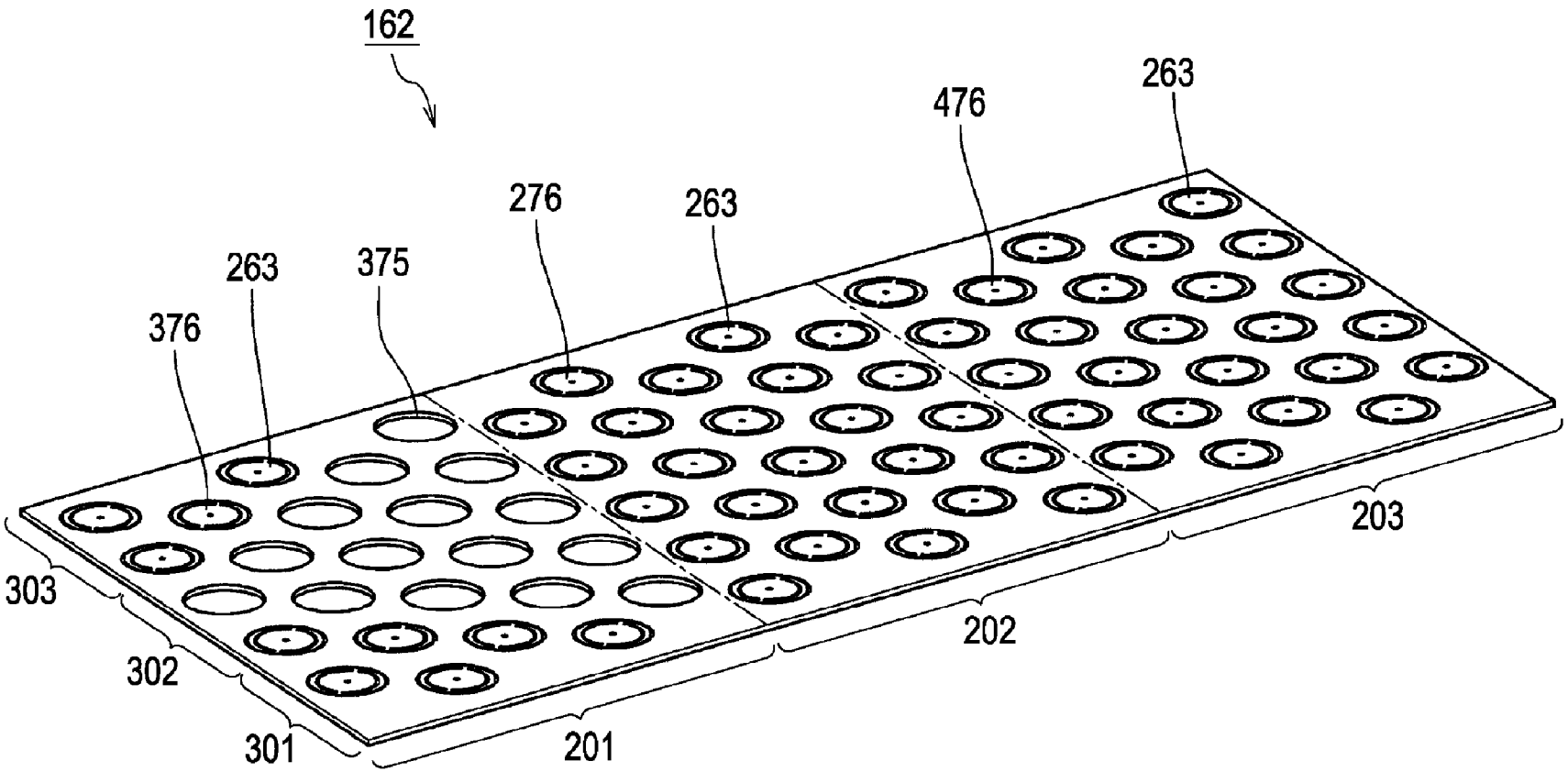
FIG. 11 is a perspective view illustrating another valve plate disposed in the upstream chamber, the recording area chamber and the downstream chamber.

FIG. 11 is a perspective view illustrating a valve plate 162 which has another structure and is arranged in the upstream chamber 158, the recording area chamber 160 and the downstream chamber 159. In the center section 302 of the upstream area 201, the valve plate 162 is provided with open holes 375 formed therein.

Since none of the open holes 375 have the valve 263, the open holes 375 do not disturb the flows of the air between the hole-side channel sections 262 and the suction-side channel sections 265. Accordingly, in the center section 302 of the upstream area 201, the transport belt 140 sucks the sheet P with a strong suction force.

In the end sections 301 and 303 of the upstream area 201, the hole-side channel sections 262 have the valves 263, respectively. Accordingly, air flow rates of the hole-side channel sections 262 which do not contribute to the suction of the sheet P are lowered.

Further, in the upstream area 201, the number of the open holes 375 in the width direction perpendicular to the transport direction gradually increases along the transport direction. Accordingly, first, the transported sheet P is strongly sucked onto the transport belt 140 in the center section 302 and then the area in which the sheet P is strongly sucked gradually becomes large in the width direction of the sheet P. Thus, the sheet P can be brought into close contact with the transport belt 140 over the entire width thereof.

In the upstream area 201 in the transport direction, the number of the valves 263 arranged to correspond to the hole-side channel sections 262 in the center section 302 in the direction perpendicular to the transport direction of the sheet P may be smaller than the number of the valves 263 arranged to correspond to the hole-side channel sections 262 in the opposite end sections 301 and 303. Accordingly, a state in which the suction force in the center section 302 is larger than the suction force in the opposite end sections 301 and 303 can be regularly formed.

Figure 12A:
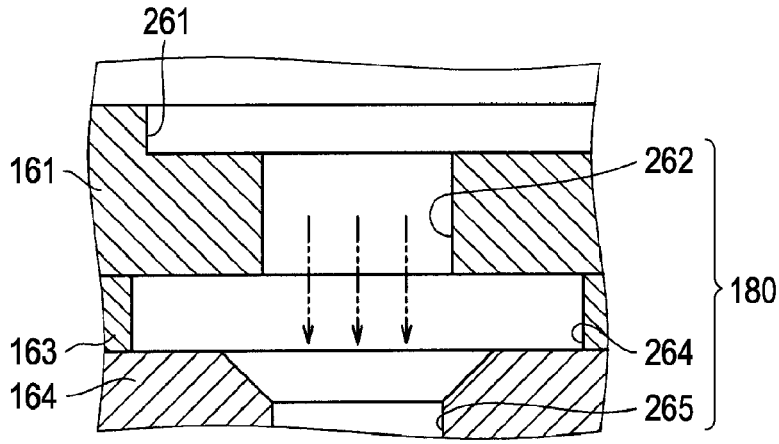
FIGS. 12A to 12C are partial sectional side views illustrating the upstream chamber, the recording area chamber and the downstream chamber.
Figure 12B:
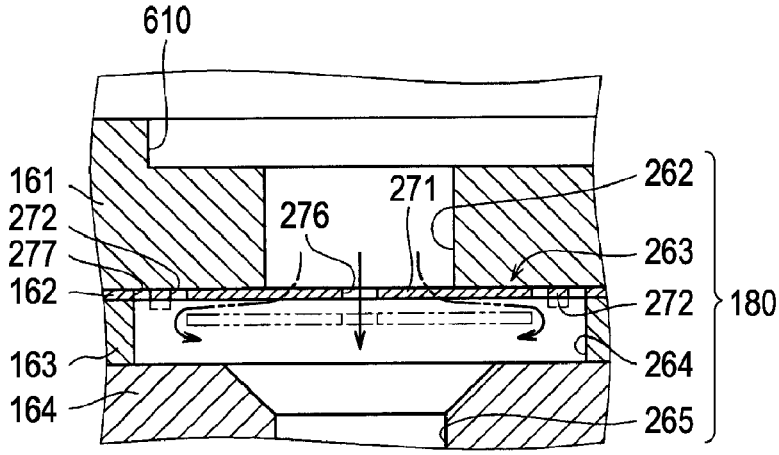
Figure 12C:
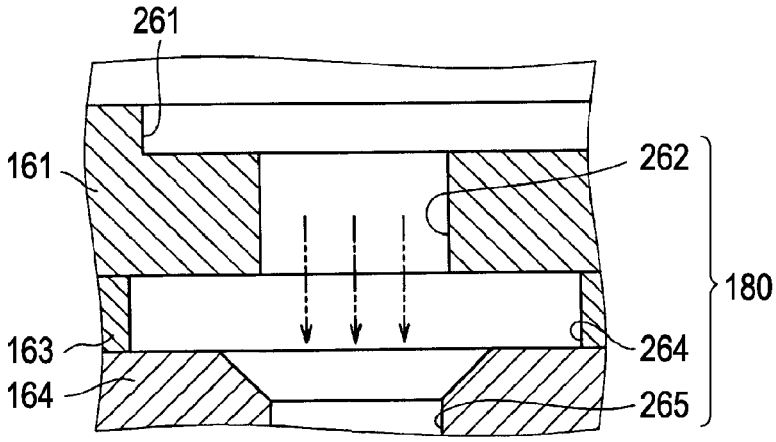

FIGS. 12A to 12C are partial sectional side views illustrating the upstream chamber 158, the recording area chamber 160 and the downstream chamber 159. As illustrated in FIGS. 12A and 12C, in the upstream chamber 158 and the downstream chamber 159, the valve plate 162 is not present between the belt receiving plate 161 and the spacer plate 163, so the valve chambers 264 have no valve 263. Accordingly, a channel cross-sectional area of the valve chambers 264 is constant regardless of whether the sheet P blocking the through holes 142 is present.

Therefore, the area at the center in which the valve plate 162 is not present exhibits a large suction force larger than that at the opposite ends and forms the first area which gradually becomes large along the transport direction. The area in which the valves 263 are arranged generates a smaller suction force and gradually decreases along the transport direction to form the second area.

As illustrated in FIG. 12B, in the recording area 160, the valve plate 162 is present between the belt receiving plate 161 and the spacer plate 163, so the valves 263 are present in the valve chambers 264, respectively. Accordingly, a channel cross-sectional area of the valve chambers 264 increases when the through holes 142 are blocked by the sheet P and the channel cross-sectional area decreases when the through holes 142 are opened.

Accordingly, in the recording area 202, when the through holes 142 are opened, the suction amounts from the through holes 142 are decreased by the valves 263. On the other hand, in the upstream area 201, the suction force generated in the through holes 142 when the sheet P is transported to the vicinity of the through holes 142 is not decreased. Accordingly, airflow generated in the recording area 202 can be made weaker than airflow generated in the upstream area 201, and in the upstream area 201, the suction force generated in the through holes 142 when the sheet P is transported to the vicinity of the through holes 142 can be made stronger than that in the recording area 202.

In this embodiment, the valves 263 are not arranged in the upstream area 201. However, the recording area 202 may be provided with a larger number of the valves 263 than in the upstream area 201 and the valves 263 may be arranged in the upstream area 201. In this case, the valves 263 may be arranged so that the number of the valves 263 gradually increases from the upstream side to the downstream side in the transport direction.

As described above, the embodiments of the invention have been described. However, the technical scope of the invention is not limited to the above description. It is obvious to those skilled in the art that various changes or modifications may be made to the embodiments. It is obvious from the claims that configurations to which such changes or modifications are made can be also included in the technical scope of the invention.

What is claimed is:

1. A recording device comprising:

a recording head which performs a recording operation on a recording medium;

a transport member which has a plurality of through holes arranged therein and transports the recording medium; and a suction unit which has a suction force generating section for generating a suction force for sucking air and a plurality of communication channels for communicating the suction force generating section with the respective through holes and generates a suction force in the through holes to suck the recording medium onto the transport member, wherein on an upstream side of a recording area in a transport direction, a suction force at a center in a direction perpendicular to the transport direction of the recording medium is larger than a suction force at opposite ends, wherein the suction unit includes flow rate adjusting sections arranged to correspond to the through holes and provided to decrease a channel cross-sectional area of the communication channels corresponding to the through holes which are opened, as compared to a channel cross-sectional area of the communication channels corresponding to the through holes which are blocked by the recording medium.

2. The recording device according to claim 1, wherein the suction force at the opposite ends gradually increases from the upstream side in the transport direction to the recording area in the suction unit.

3. The recording device according to claim 1, wherein on the upstream side in the transport direction, the number of the communication channels at the center in the direction perpendicular to the transport direction of the recording medium is larger than the number of the communication channels at the opposite ends.

4. The recording device according to claim 1, wherein on the upstream side in the transport direction, the number of the flow rate adjusting sections arranged to correspond to the plurality of communication channels at the center in the direction perpendicular to the transport direction of the recording medium is smaller than the number of the flow rate adjusting sections arranged to correspond to the plurality of communication channels at the opposite ends.

5. The recording device according to claim 1, wherein the communication channel has a hole-side channel section which is closer to the through holes than the flow rate adjusting section and a suction-side channel section which is closer to the suction force generating section than the flow rate adjusting section, and wherein the flow rate adjusting section has a diaphragm which is arranged between the hole-side channel section and the suction-side channel section and is displaced toward the hole-side channel section or the suction-side channel section by a differential pressure between the hole-side channel section and the suction-side channel section, an open-close communication hole which is formed in the diaphragm, is opened and closed by the displacement of the diaphragm and communicates the hole-side communication section with the suction-side communication section in an opened state, and an open communication hole which is formed in the diaphragm, is opened regardless of the position of the diaphragm and communicates the hole-side communication section with the suction-side communication section.

6. A recording device comprising:

a first suction unit which sucks and supports a recording medium;

a recording head which performs a recording operation on the recording medium supported by the first suction unit; and a second suction unit which sucks and transports the recording medium to supply the recording medium to the first suction unit, wherein the second suction unit has a first area in which a first suction force is generated and a second area in which a second suction force smaller than the first suction force is generated or no suction force is generated, wherein the first area is disposed closer to the center than the second area in a direction perpendicular to a transport direction and gradually increases along the transport direction, and wherein the second area is disposed closer to the opposite ends than the first area in the direction perpendicular to the transport direction and gradually decreases in size along the transport direction, wherein the suction unit includes flow rate adjusting sections arranged to correspond to the through holes and provided to decrease a channel cross-sectional area of the communication channels corresponding to the through holes which are opened, as compared to a channel cross-sectional area of the communication channels corresponding to the through holes which are blocked by the recording medium.

* * * * *